US007757529B2

(12) United States Patent
Taniyama

(10) Patent No.: US 7,757,529 B2
(45) Date of Patent: Jul. 20, 2010

(54) METHOD AND APPARATUS FOR FLAT TUBE ROLL FORMING AND FLAT TUBE FORMED THEREBY

(75) Inventor: Toshihiro Taniyama, Tokoname (JP)

(73) Assignee: Denso Corporation, Kariya (JP)

( * ) Notice: Subject to any disclaimer, the term of this patent is extended or adjusted under 35 U.S.C. 154(b) by 586 days.

(21) Appl. No.: 11/783,403

(22) Filed: Apr. 9, 2007

(65) Prior Publication Data

US 2007/0240473 A1 Oct. 18, 2007

(30) Foreign Application Priority Data

Apr. 12, 2006 (JP) ..... 2006-109445

(51) Int. Cl.
*B21D 5/08* (2006.01)
*B21C 37/06* (2006.01)

(52) U.S. Cl. ..... 72/181; 72/368

(58) Field of Classification Search ..... 72/176, 72/177, 179, 181, 367.1, 368, 369; 29/890.053
See application file for complete search history.

(56) References Cited

U.S. PATENT DOCUMENTS 5,875,668 A 3/1999 Kobayashi et al.

FOREIGN PATENT DOCUMENTS

| | | |
|---|---|---|
| JP | A 63-242432 | 10/1988 |
| JP | A 6-123571 | 5/1994 |
| JP | A 10-085877 | 4/1998 |
| JP | A 2004-009087 | 1/2004 |

*Primary Examiner*—Dana Ross
*Assistant Examiner*—Debra M Sullivan
(74) *Attorney, Agent, or Firm*—Oliff & Berridge, PLC

(57) ABSTRACT

A method of roll forming a flat tube having a substantially θ-shaped section comprising the steps of forming a substantially triangular protrusion 72 having a roundish top, and closely attaching the opposed base end portions of the substantially triangular protrusion 72 having a roundish top while leaving a hollow portion 73*a* at the forward end of the protrusion 72, thereby forming a protrusion 73 having a closely-attached based end portion and forward-end hollow portion 73*a*.

6 Claims, 9 Drawing Sheets

METHOD AND APPARATUS FOR FLAT TUBE ROLL FORMING AND FLAT TUBE FORMED THEREBY

BACKGROUND OF THE INVENTION

1. Field of the Invention

This invention relates to a method and an apparatus for roll forming a flat tube having a central reinforcement used for a heat exchanger or the like, and the flat tube.

2. Description of the Related Art

A flat tube for passing a heat exchange fluid is used for heat exchangers such as a radiator or a hot-water heater for automotive vehicles. Such a flat tube is brazed to a container (tank or the like) of the heat exchanger. A flat tube having an θ-shaped section with a central reinforcement is used for a wide heat exchanger. A method of roll forming the flat tube having the θ-shaped section from a single continuous plate material is disclosed in Japanese Unexamined Patent Publications Nos. 10-85877 and 2004-9087 filed by the same applicant as the applicant of the present invention.

The reinforcement of the flat tube is formed of perpendicular L-shaped bends and a folded rib formed of mountain-shaped folded-back portions, and therefore a very small depression is formed on the outer surface contour by the roundness at each bend of the plate material. This depression, though very small, results in a shortage of solder material used to braze the flat tube to the container of the heat exchanger and is required to be reduced as far as possible.

Especially, according to the roll forming method disclosed in Japanese Unexamined Patent Publications Nos. 10-85877 and 2004-9087, the depression generated at the base of the folded rib is reduced by upsetting the folded rib. In order to obtain a brazed joint high in reliability, it is desirable to further reduce such a depression.

SUMMARY OF THE INVENTION

In view of the problem described above, the object of this invention is to provide a roll forming method and apparatus capable of reducing the depression generated at the base of a folded rib having mountain-shaped folded-back portions of a flat tube and resulting in a flat tube with a small depression.

In order to achieve this object, the present invention employs the techniques described below.

According to one aspect of the invention, there is provided a roll forming method for sequentially bending a single long band plate material into a flat tube (1) including flat plate portion pairs (3, 4) opposed in relation to each other, a pair of peripheral curved plate portions (5) connecting the ends of the flat plate portion pairs to each other and a folded rib (7) rising upright from one of the opposed flat plate portion pairs (3) and returning to the particular flat plate portion (3), the flat tube (1) hating a substantially θ-shaped section with a substantially elliptic space defined by the flat plate portion pairs (3, 4), a pair of curved plate portions (5) and the folded rib (7), the method comprising:

a roll forming step (A) to form a substantially triangular protrusion (72) having a roundish top on a flat plate portion (10) of the band plate material; a roll forming step (B) to closely attach the two opposed base end portions while leaving a hollow portion (73*a*) at the forward end of the substantially triangular protrusion (72) having a roundish top thereby to form a protrusion (73) having closely-attached base end portions and forward-end hollow portion (73*a*); a roll forming step (C) to form a protrusion (73) into a folded rib (7) with the both sides thereof closely attached to each other; a roll forming step (D) to upset the folded rib (7) from above and thus reduce the depression (7*c*) formed in the plate portion (10) of the band plate material by the bends (7*b*) between the flat plate portion (10) and the folded rib (7); a roll forming step (E) to form an L-shaped bend (6) at each transverse end of the band plate material: and a roll forming step (F) to bend the intermediate portion between each L-shaped bend (6) and the folded portion (7) into a semicircle and opposing the flat plate portion pairs (3, 4) to each other while at the same time placing the L-shaped bends (6) into contact with the sides of the folded rib (7).

In the roll forming means according to the invention, before forming the fold rib (7) with both sides thereof closely attached to each other, the protrusion (73) having the forward-end hollow portion (73*a*) and the base end portions closely attached to each other is formed in the roll forming step (B). Therefore, the depression (7*c*) formed by the bends between the flat portion of the band plate material and the folded rib (7) can be easily reduced in the roll forming step (D), thereby making it possible to obtain a flat tube with a small depression (7*c*).

In this invention, the roll forming step (A) is executed by a roll forming means (120) having a pair of rolls ($\mathbf{120}_u$, $\mathbf{120}_D$) to form a substantially triangular protrusion (72) having a roundish top from an isosceles trapezoidal protrusion (71) precedently formed in the flat portion (10) of the band plate material while the inner surface of the upper side of the isosceles trapezoidal protrusion (71) is in contact with the flange-like portion (120*b*) having a roundish forward-end part of a predetermined radius of curvature (R) projected diametrically from the roll ($\mathbf{120}_D$).

As a result, the plastic strain generated in the substantially triangular protrusion (72) formed in the roll forming step (A) can be suppressed, and the protrusion (73) can be positively formed in the next roll forming step (B).

According to another aspect of the invention, there is provided a roll forming apparatus for sequentially bending and forming a single long band plate material into a flat tube (1) including flat plate portion pairs (3, 4) opposed in relation to each other, a pair of peripheral curved plate portions (5) connecting the ends of the flat plate portions to each other and a folded rib (7) rising upright from one of the opposed flat plate portion pairs (3) and returning to the particular flat plate portion (3), the flat tube (1) has a substantially θ-shaped section with a substantially elliptic space defined by the flat plate portion pairs (3, 4), the pair of curved plate portions (5) and the folded rib (7), the apparatus comprising: a roll forming means (120) to form a substantially triangular protrusion (72) having a roundish top on a flat plate portion (10) of the band plate material; a roll forming means (130) to closely attach the two opposed base end portions while leaving a hollow portion (73*a*) at the forward end of the substantially triangular protrusion (72) having a roundish top thereby to form a protrusion (73) having the closely attached base end portions and the forward-end hollow portion (73*a*); a roll forming means (140) to form the protrusion (73) into a folded rib (7) with both sides thereof closely attached to each other; a roll forming means (150) to upset the folded rib (7) from above and thus reduce the depression (7*c*) formed in the flat plate portion (10) of the band plate material by the bends (7*b*) between the flat plate portion (10) and the folded rib (7); a roll forming means (160) to form an L-shaped bend (6) at each transverse end of the band plate material; and a roll forming means (170) to bend the intermediate portion between each L-shaped bend (6) and the folded portion (7) into a semicircle and opposing the flat plate portion pairs (3, 4) to each other while at the same time placing L-shaped bends (6) into contact with the sides of the folded rib (7).

As a result, a flat tube with a small depression (7*c*) generated in the flat plate portion (10) at the base of the folded rib (7) can be formed.

In the roll forming apparatus according to this aspect of the invention, the roll forming means (120) for forming the substantially triangular protrusion includes a pair of rolls ($\mathbf{120}_U$, $\mathbf{120}_D$), of which the roll ($\mathbf{120}_D$) includes a flange-like portion (120*b*) having a diametrically projected roundish forward end of a predetermined radius of curvature (R), and at the time of roll forming the substantially triangular protrusion (72) having a roundish top, the flange-like portion (120*b*) comes into contact with the inside of the top of the substantially triangular protrusion (72).

As a result, the plastic strain generated in the substantially triangular protrusion (72) formed in the roll forming step (A) can be suppressed, and the protrusion (73) can be positively formed in the next roll forming step (B).

In this invention, the predetermined radius of curvature (R) of the flange-like portion (120*b*) is substantially equal to the thickness (t) of the band plate material.

The roll forming means (130) for forming the protrusion having the hollow portion has a pair of rolls ($\mathbf{130}_L$, $\mathbf{130}_R$), each of which has a large-diameter portion (130*a*) to press and closely attach the base end portions of the protrusion (73) having the forward-end hollow portion (73*a*) and a small-diameter portion (130*b*) to form the forward end portion having the hollow portion (73*a*) of the protrusion (73).

As a result, the protrusion (73) having the closely-attached based end portions and the forward-end hollow portion required to secure a small depression (7*c*) can be positively formed.

According to another aspect of the invention, there is provided a flat tube (1) comprising flat plate portion pairs (3, 4) opposed in relation to each other, a pair of curved plate portions (5) connecting the ends of the flat plate portion pairs, and a folded rib (7) rising upright from one of the opposed flat plate portion pairs (3) and returning to the particular flat plate portion (3) opposed to the flat plate portion pair (4), wherein a substantially elliptic space formed by the flat plate portion pairs (3, 4) and the curved plate portions (5) is defined by the folded rib (7) thereby to form a substantially θ-shaped section, wherein if the flat tube (1) is formed of a material having a thickness (t) in the range of 0.2 mm to 0.35 mm inclusive, the shortest distance (q) from the intersection (0) between the center axis (CL) of the folded rib (7) to the extension of the outer surface of one of the flat plate portions (3) to the outer surface of the bend (7*b*) generated between the particular flat plate portion (3) and the folded rib (7) is less than 0.1 mm.

This configuration can eliminate a shortage of brazing material to be filled in the brazing joint between the flat tube (1) and the container of the heat exchanger.

The reference numerals inserted in the above parentheses attached to each means indicate the correspondence with the specific means described in the embodiments later.

The present invention may be more fully understood from the description of the preferred embodiments of the invention, as set forth below, together with the accompanying drawings.

DESCRIPTION OF THE PREFERRED EMBODIMENTS

Figure 1:
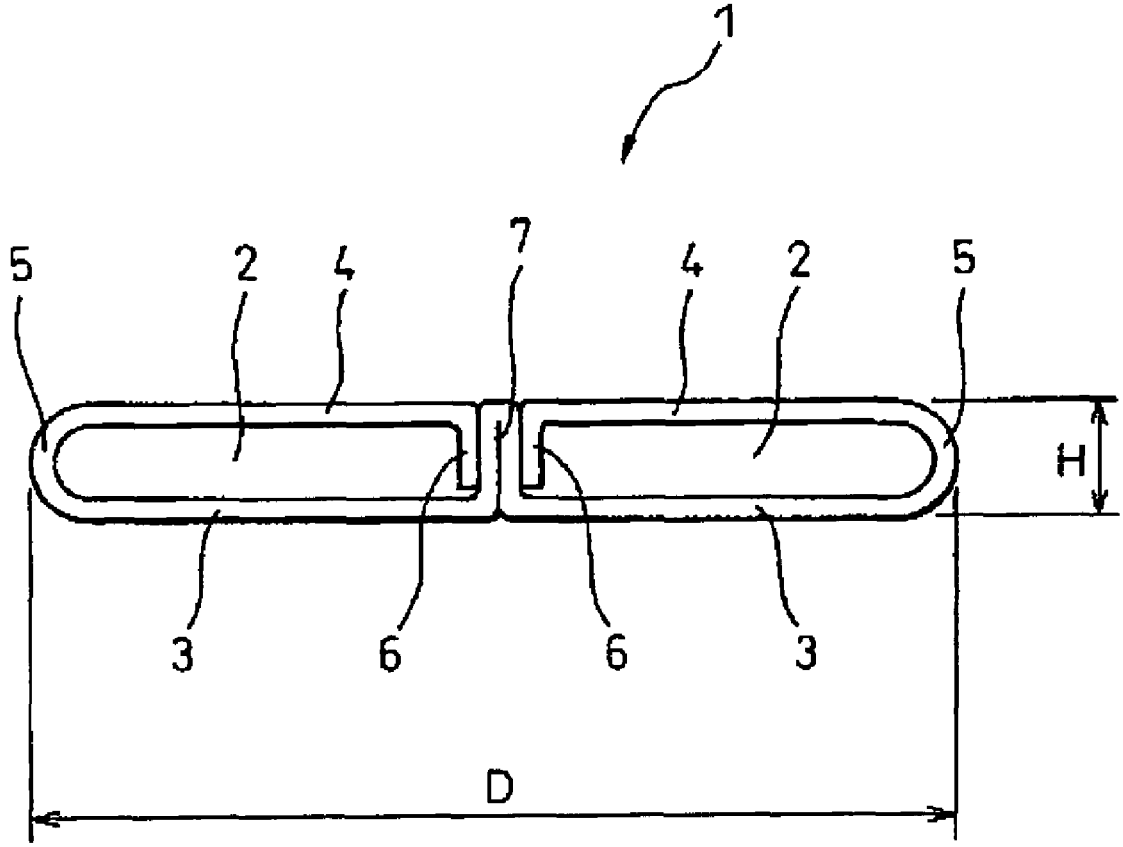
FIG. 1 is a cross sectional view showing a flat tube formed by the roll forming method according to an embodiment of the invention.

First, the flat tube formed by the roll forming method according to the invention is explained with reference to FIG. 1. FIG. 1 is a sectional view of the flat tube 1 having an θ-shaped section, in which two flat flow paths 2 are defined by a pair of flat plate portions 3, a pair of second flat plate portions 4, a pair of curved plate portions 5 and a pair of L-shaped bends 6. A folded rib 7, in which a plate is folded back and the folded-back plate portions are laid one over the other, is held between the pair of the L-shaped bends 6. The flat tube 1 is formed typically of an aluminum alloy having the thickness t in the range of 0.2 to 0.35 mm, a width D of about 16 to 27 mm and height H of about 1.4 to 1.8 mm. Accordingly, the width of the band plate material is in the range of about 40 to 60 mm. The flat tube, after being formed by the roll forming method according to the invention, is cut to a predetermined length, and the folded rib 7 and L-shaped bends 6 on both sides thereof are coupled to each other by brazing.

Figure 2A:
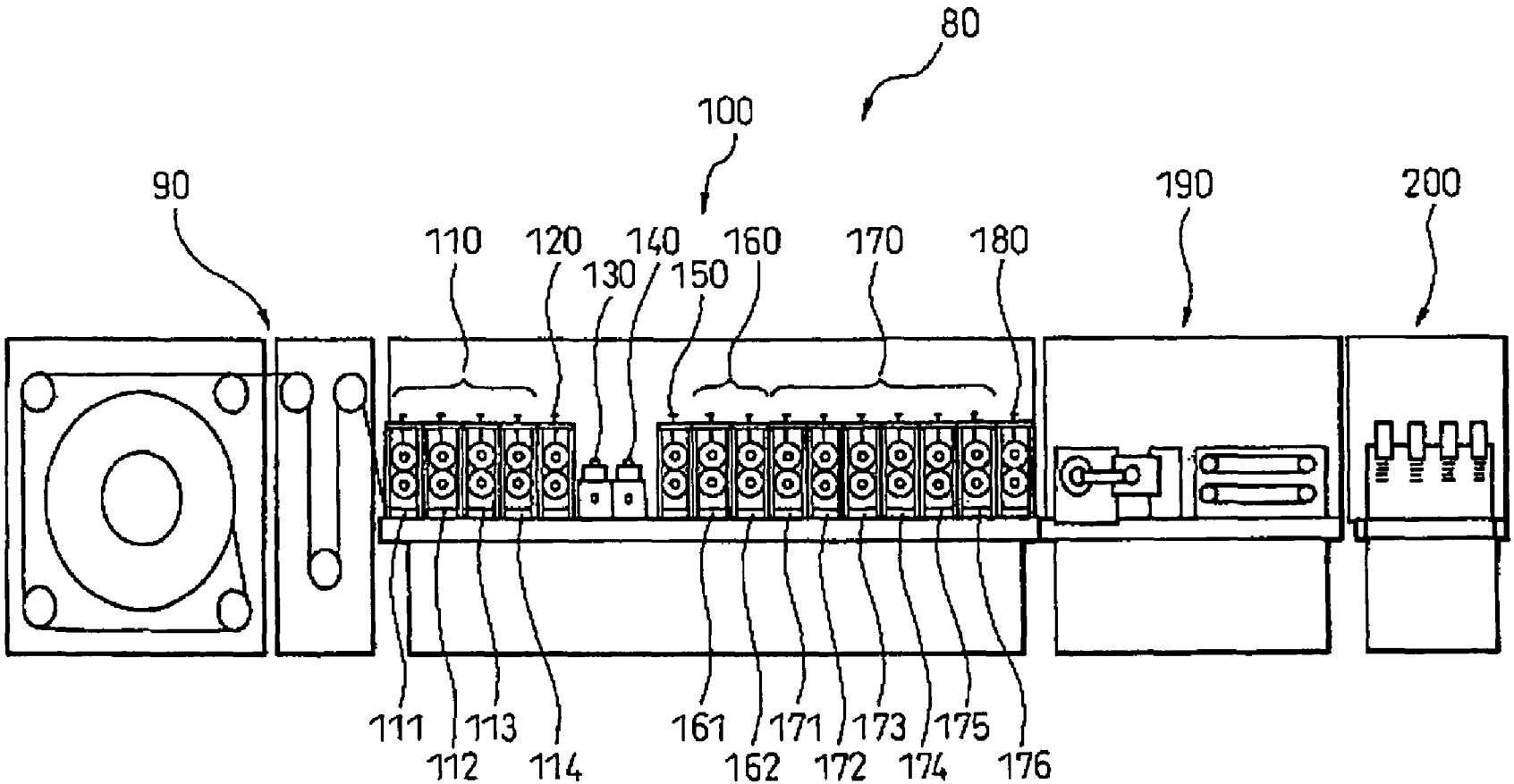
FIG. 2A is a front view schematically showing a brazed tube fabrication machine including the roll forming apparatus according to an embodiment of the invention.
Figure 2B:
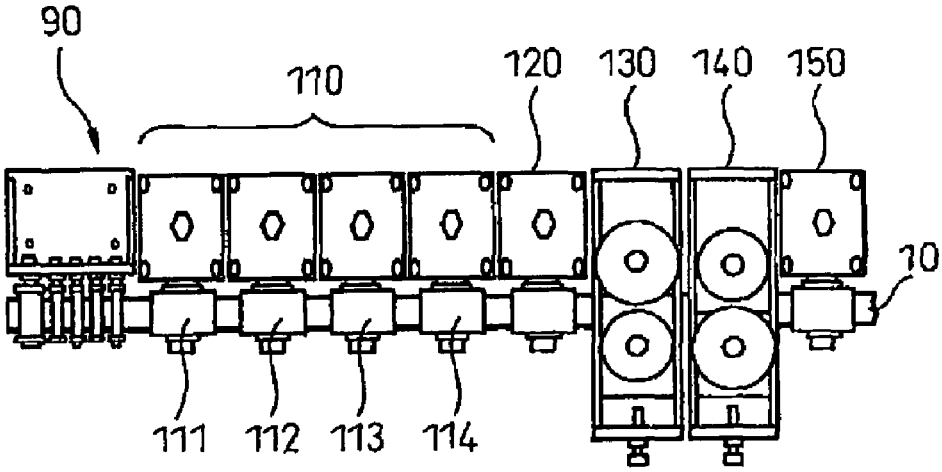
FIG. 2B is a plan view schematically showing the first to fifth roll forming means making up a part of the roll forming apparatus.
Figure 3A:
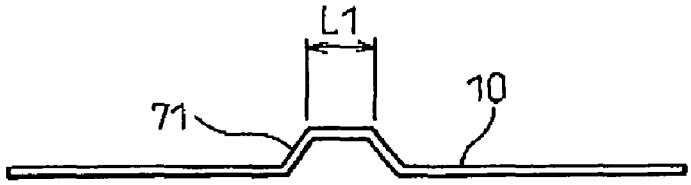
FIGS. 3A to 3D are sectional views showing an isosceles trapezoidal protrusion formed in the first roll forming step included in the roll forming method.
Figure 3B:
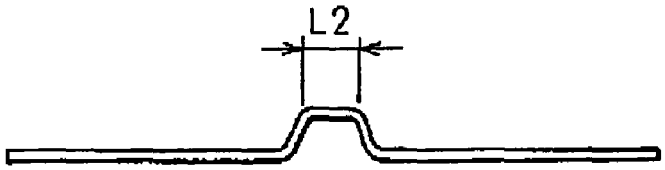
Figure 3C:
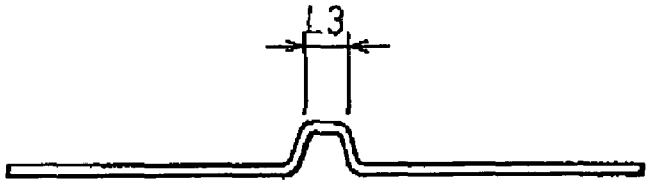
Figure 3D:
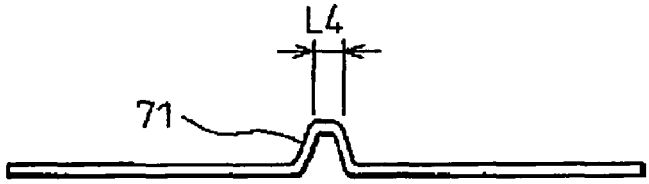

Next, a method and an apparatus for roll forming the flat tube are explained. FIG. 2A is a front view schematically showing a brazed tube fabrication machine 80 including the roll forming apparatus 100 according to a preferred embodiment of the invention. FIG. 2B is a plan view schematically showing roll forming means 110, 120, 130, 140, 150 of the roll forming apparatus 100 for executing the steps to form the folded rib. FIGS. 3 to 8 are sectional views of the material used in each roll forming step, and FIGS. 9 to 13 are diagrams showing the shape of the rolling die of each roll forming means.

A brazed tube fabrication machine 80 is used for forming, cutting and brazing the flat tube for the heat exchanger from a single long band plate material. This brazed tube fabrication machine 80, as shown in FIG. 2A, includes an uncoiler unit 90 for supplying the material wound in a coil, a roll forming apparatus 100 according to the invention, a cutting unit 190 and a braze-loading unit 200. The roll forming apparatus 100 includes a first roll forming means 110 having four roll sets 111 to 114 to form an isosceles trapezoidal protrusion 71 at the transverse central portion of the flat plate portion 10 of the band plate material and reduce the upper width of the protrusion 71 from L1 to L4 stepwise (FIGS. 3A to 3D); a second roll forming means 120 to form a substantially isosceles triangular protrusion 72 having a roundish top from the isosceles trapezoidal protrusion 71 (FIG. 4); a third roll forming means 130 to closely attach only the base end portions of the substantially isosceles triangular protrusion 72 to each other while leaving the forward end portions of the two equal sides thereof without being closely attached to each other thereby to form a hairpin-like protrusion 73 having closely-attached base end portions and a forward-end hollow portion 73*a* (FIG. 5); a fourth roll forming means 140 to form a linear folded rib having no hollow portion by closing attaching the whole inner surfaces of the two sides of the hairpin-like protrusion 73 (FIG. 6); a fifth roll forming means 150 to upset and press the folded rib 7 from above into a rectangle by reducing both the radius of curvature of the forward-end bend 7*a* and the size of the depression 7*c* formed between the opposed two sides of the bends 7*b* of the flat plate portion 10 of the band plate material (FIG. 7); a sixth roll forming means 160 including rolls 161, 162 to form L-shaped bends 6 not higher than the height h of the folded rib 7 at the transverse ends of the band plate material (FIGS. 8A, 8B); and a seventh roll forming means 170 including rolls 171 to 176 to bend the intermediate portion between each of L-shaped bends 6 and the folded rib 7 into a semicircle and set the first flat plate portion 3 and the second flat plate portion 4 in parallel to each other while at the same time arranging the L-shaped bends 6 into contact with the side surfaces of the folded rib 7 (FIGS. 8C, 8D, 8E). The axial direction of the rotary shafts of the third and fourth roll forming means 130 and 140 are vertical, and those of the other roll forming means are horizontal.

Figure 9:
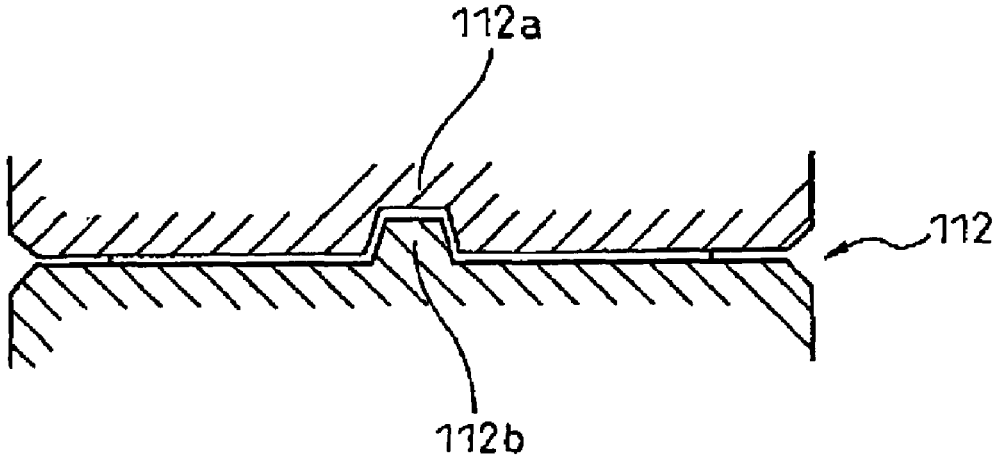
FIG. 9 is a longitudinal sectional view showing the shape of a set of rolling dies making up the first roll forming means.
Figure 10:
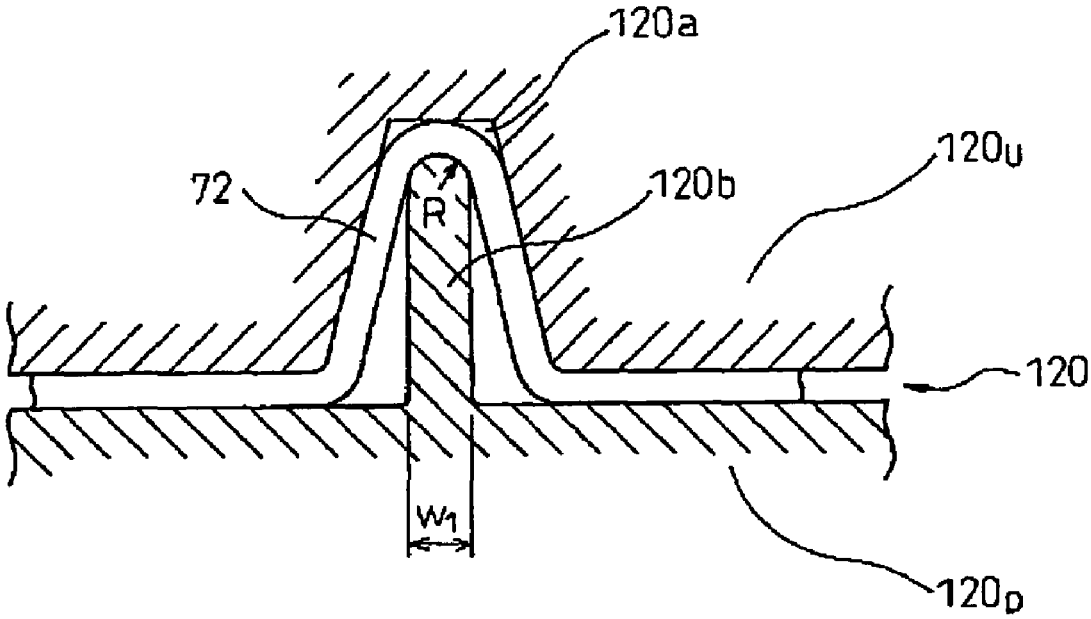
FIG. 10 is a longitudinal sectional view showing the shape of the dies of the second roll forming means.

Next, the roll forming method and apparatus according to an embodiment of the invention are explained in detail. First, the isosceles trapezoidal protrusion 71 as shown in FIGS. 3A to 3D is formed by the first roll forming step. Each of the roll sets 111 to 114 of the first roll forming means 110 to form the isosceles trapezoidal protrusion 71 has an upper roll and a lower roll. The upper roll is formed with an upper roll groove in the shape of the isosceles trapezoid and the lower roll is formed with a lower roll protrusion in the shape of the isosceles trapezoid. FIG. 9 is a longitudinal sectional view showing an example of the upper roll groove 112*a* and the lower roll protrusion 112*b* of the rolls 112.

Figure 4:
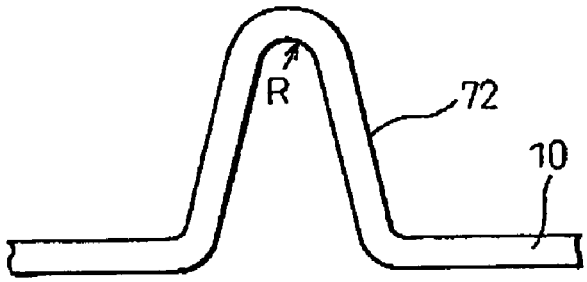
FIG. 4 is a sectional view showing a substantially isosceles triangular protrusion having a roundish top formed in the second roll forming step included in the roll forming method.
Figure 5:
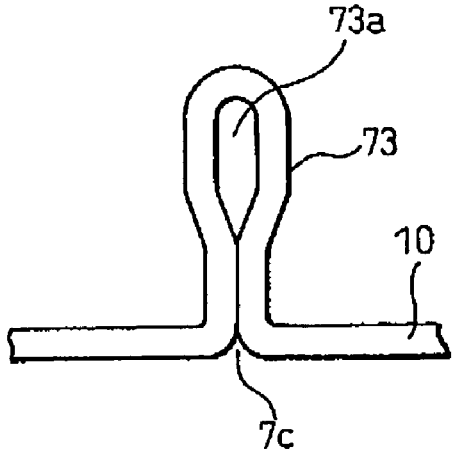
FIG. 5 is a sectional view showing a hairpin-like protrusion having a forward-end hollow portion and closely-attached base end portion formed in the third roll forming step included in the roll forming method.
Figure 6:
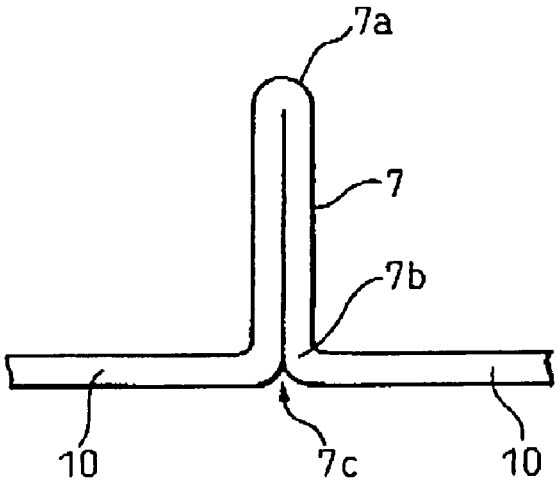
FIG. 6 is a sectional view showing a folded rib formed in the fourth roll forming step included in the roll forming method.
Figure 7:
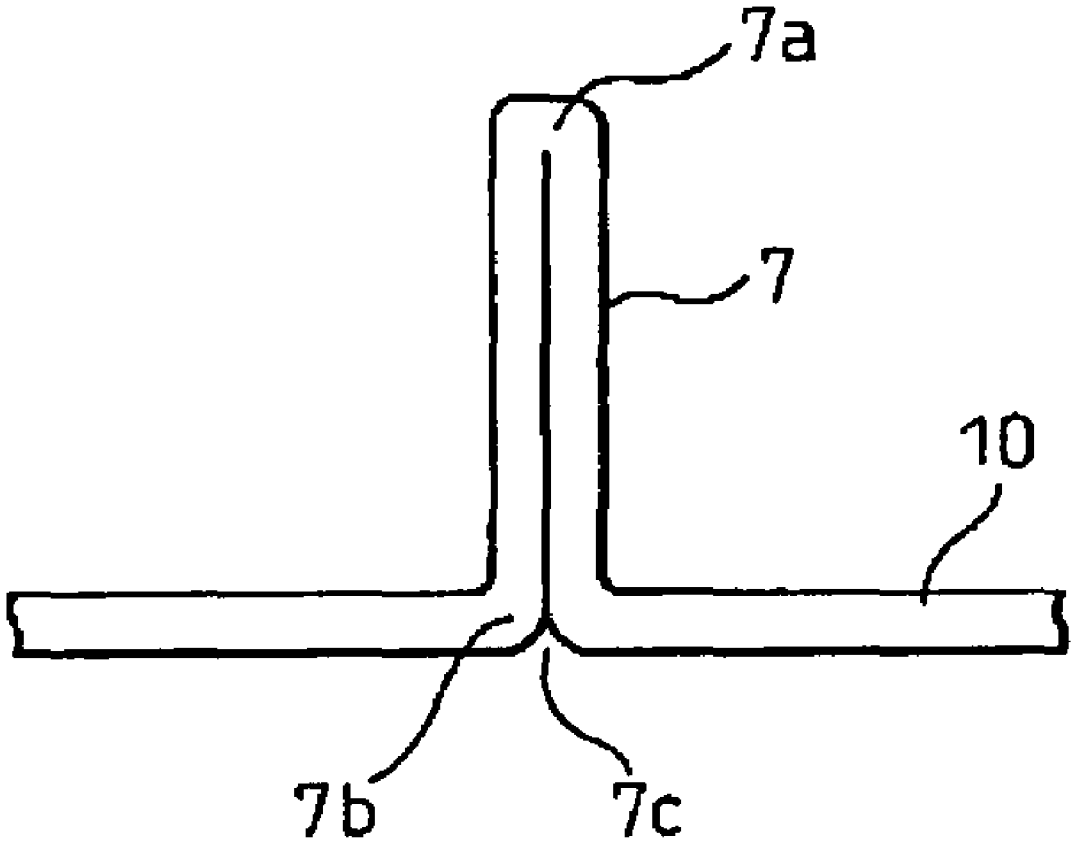
FIG. 7 is a sectional view showing a folded rib shaped in the fifth roll forming step included in the roll forming method.

Next, in the second roll forming step, a substantially isosceles triangular protrusion 72 having a roundish top shown in FIG. 4 is formed. According to this embodiment, the roundish portion has an inner radius of curvature R equal to the thickness t of the band plate material. The second roll forming means 120 to form this substantially isosceles triangular protrusion having a roundish top, as shown in the longitudinal sectional view of FIG. 10, has an upper roll $\mathbf{120}_U$ formed with a comparatively narrow isosceles trapezoidal upper roll groove 120*a* and a lower roll $\mathbf{120}_D$ formed with a lower roll flange-like portion 120*b* as an upright protrusion. The lower roll flange-like portion 120*b* has a roundish portion having the radius of curvature R at the forward end thereof. According to this embodiment, the lower roll flange-like portion 120*b* has a width $w_1$ twice that of the thickness t of the band plate material.

Figure 11:
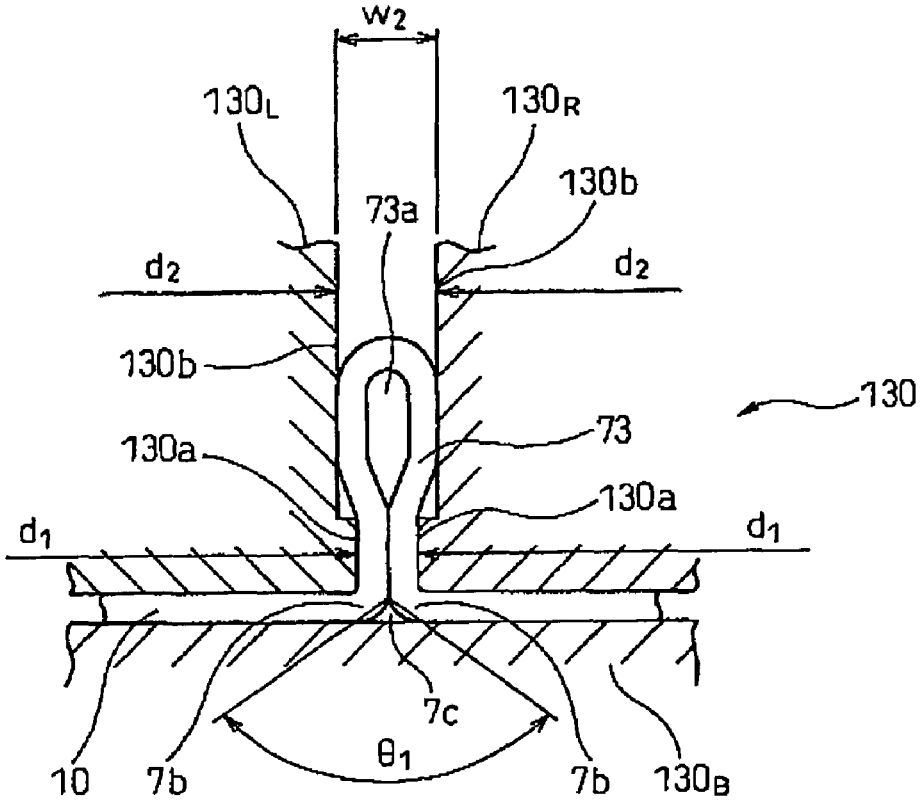
FIG. 11 is a longitudinal sectional view showing the shape of the dies of the third roll forming means.

Next, in the third roll forming step, the base end portions of the substantially isosceles triangular protrusion 72 having a roundish forward end formed in the preceding step are closely attached to each other by the third roll forming means 130 shown in FIG. 11. Thus, a hairpin-like protrusion 73 is formed in which the base end portions are closely attached to each other while the hollow portion 73*a* is left between the opposed two sides at the forward end portion. According to the embodiment, the closely attached base end portions represent about one half of the total height of the hairpin-like protrusion 73 has, and the width $w_2$ of the forward end portion thereof is about 3 to 3.5 times the thickness t. The third roll forming means 130 to form this hairpin-like protrusion 73 includes a right roll $\mathbf{130}_R$ and a left roll $\mathbf{130}_L$ having a vertical rotary axis and a support unit $\mathbf{130}_B$. The right and left rolls each include a large-diameter portion 130*a* having the diameter d1 for pressing the base end portions of the hairpin-like protrusion 73 and a small-diameter portion 130*b* arranged above the large-diameter portion 130*a* and having the diameter d2 for forming the width $W_2$ at the forward end portion of the hairpin-like protrusion 73.

Between the hairpin-like protrusion 73 and the flat plate portions 10 of the band plate material, a pair of bends 7*b* are formed thereby to form a substantially isosceles triangular depression 7*c* with inwardly curved hypotenuses. By applying pressure to closely attach only the base end portions to each other as described above, the apex of the substantially isosceles triangle of the depression 7*c* is located lower than the upper surface of the flat plate portions 10. Assuming that the hypotenuses of the triangle are rectilinear as shown in FIG. 11, the apical angle $\theta_1$ of the depression 7*c* would be obtuse in the roll forming method according to this embodiment.

Figure 12:
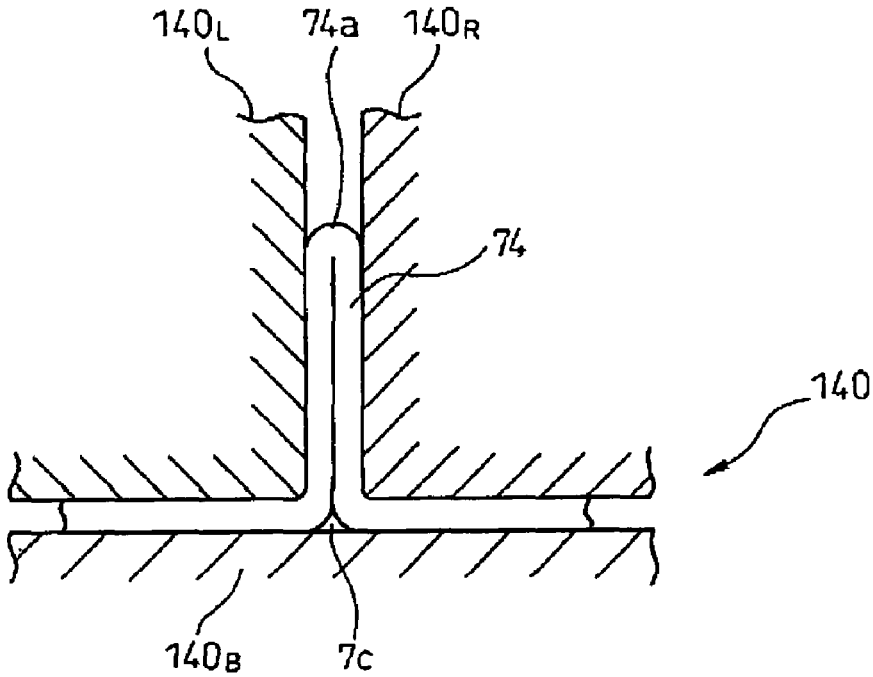
FIG. 12 is a longitudinal sectional view showing the shape of the dies of the fourth roll forming means.

Next, in the fourth roll forming step, as shown in FIG. 12, a rectilinear folded rib 7, in which both sides of the protrusion 74 are attached closely to each other, is formed by the fourth roll forming means 140 from the hairpin-like protrusion 73 having the hollow portion 73*a* with the base end portions closely attached to each other. The fourth roll forming means 140 includes a right roll $\mathbf{140}_R$ and a left roll $\mathbf{140}_L$ having vertical rotary shafts and a support unit $\mathbf{140}_B$. The right and left rolls are for pressing the whole area along the height of the protrusion including the base end portions thereof which are closely attached to each other in the preceding step.

The depression 7*c* formed by the base end portions of the rectilinear folded rib 7 has substantially the same shape and size as those of the depression 7*c* of the hairpin-like protrusion 73 described above. According to the prior art, unlike the present invention, the hairpin-like protrusion 73 having the forward-end hollow portion 73*a* with the base end portions closely attached to each other is not formed in the steps before forming the rectilinear folded rib. Instead, in the prior art, a comparatively acute isosceles triangular protrusion is formed without any part supporting the material such as the lower roll flange-like portion 120*b* of the second roll forming means 120, and then the two equal sides thereof are closely attached to each other over the whole area along the height of the folded rib by applying a uniform pressure thereto. Therefore, the upper end of the depression formed by the bends of the flat plate portions with the folded rib is difficult to locate under the upper surface of the flat plate portions. Also, the apical angle $\theta_1$ of the depression triangle is acute.

Figure 13:
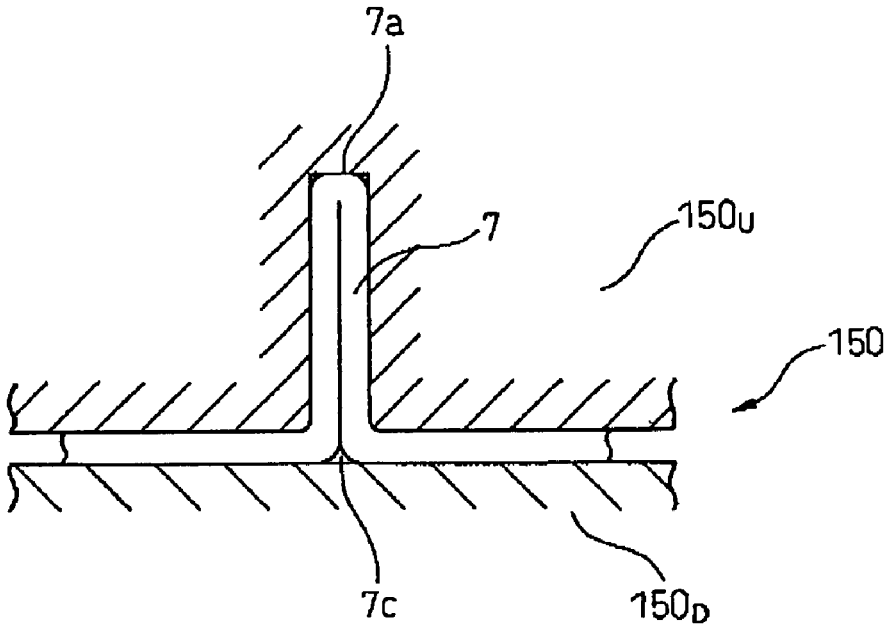
FIG. 13 is a longitudinal sectional view showing the shape of the dies of the fifth roll forming means.

Next, in the fifth roll forming step, the rectilinear folded rib 7 is upset and pressed from above by the fifth roll forming means 150 shown in FIG. 13. The fifth roll forming means 150 includes a lower roll $\mathbf{150}_D$ and an upper roll $\mathbf{150}_U$ both having a horizontal rotary shaft, the upper roll $\mathbf{150}_U$ having a groove shallower than the height of the folded rib 7 by the amount upset and pressed. The roundish forward-end bend 7*a* of the folded rib 7 is formed into a rectangle and the depression 7*c* reduced further by the compression applied from above by the fifth roll forming means 150.

Figure 14:
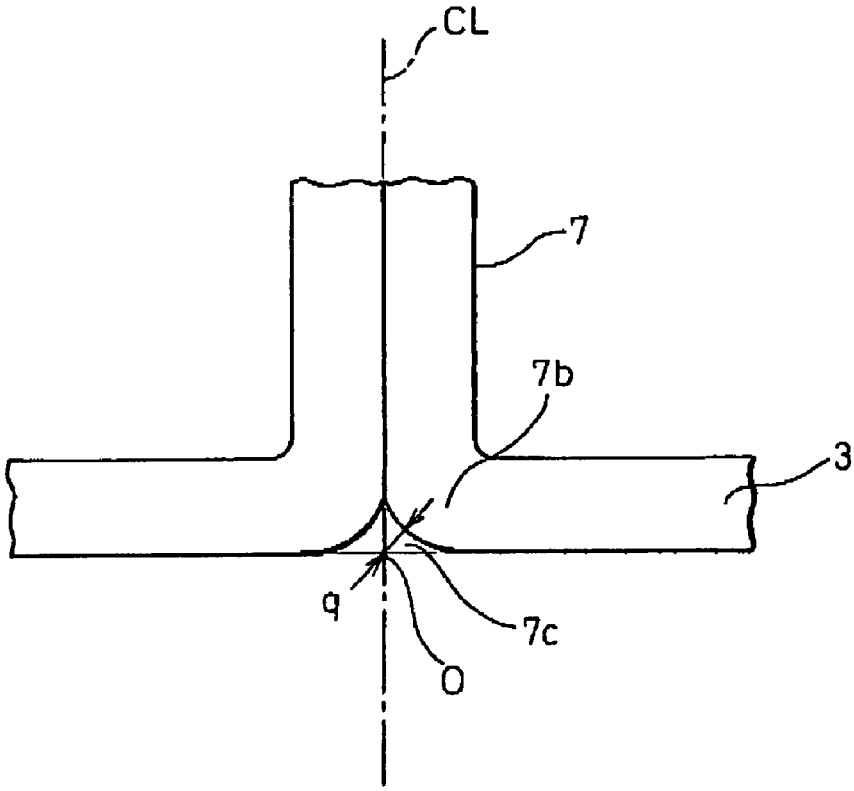
FIG. 14 is a sectional view showing the depression generated at the base of the folded rib of the flat tube formed by the base forming method according to an embodiment of the invention.

The flat tube formed by the method and apparatus according to this embodiment, as shown in FIG. 14, assume that the shortest distance from the intersection between the center axis C1 of the folded rib 7 and the extension of the outer surface of the first flat plate portion 3 to the outer surface of the bend 7*b* is q. In the case where the thickness of the band plate material is 0.2 mm, the distance q is in the range of 0.07 to 0.08 mm, while in the case where the thickness is 0.35 mm, the distance q is in the range of 0.08 to 0.09 mm. However, in the conventional method and apparatus, the distance q is not less than 0.13 mm for the thickness of 0.2 mm.

According to this invention, the hairpin-like protrusion 73 having the forward-end hollow portion 73*a* and the closely-attached base end portions is processed in the third roll forming step, with the result that the position of the apex of the substantially isosceles triangle of the depression 7*c* is lowered and the apical angle $\theta_1$ becomes obtuse, thereby making it possible to reduce the size of the depression 7*c* and the distance q. Also, in the second roll forming step according to this invention, the substantially isosceles triangular protrusion 72 having a roundish top is formed with such a plastic strain that plastic deformation is possible in the third roll forming step. In other words, the plastic strain of the plate material of the substantially isosceles triangular protrusion 72 having a roundish top formed in the second roll forming step is suppressed to such a degree that the material can be plastically deformed further to form the hairpin-like protrusion 73 in the next step.

The sixth and seventh roll forming steps executed next are well known and described only briefly below.

Figure 8A:
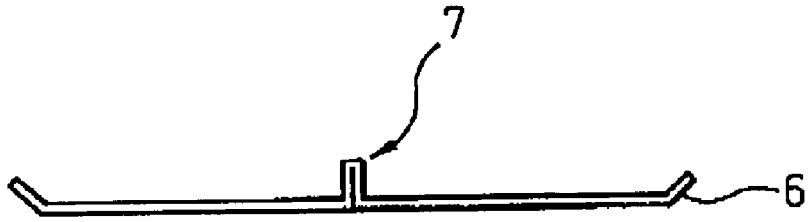
FIGS. 8A to 8E are sectional views showing the shape of the material formed in the sixth and seventh roll forming steps included in the roll forming method.
Figure 8B:
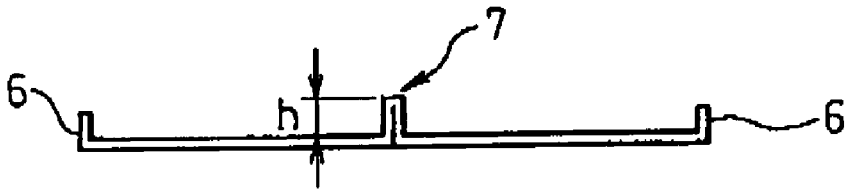
Figure 8C:
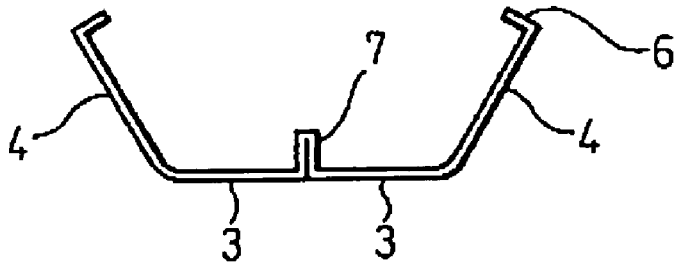
Figure 8D:
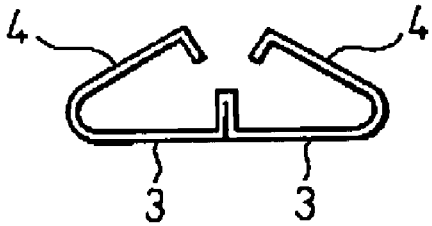
Figure 8E:
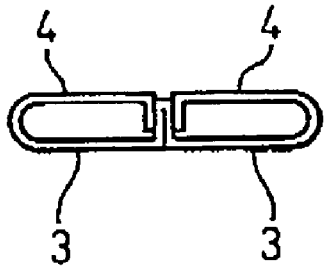

In the sixth roll forming step, the side ends of the intermediate component formed with the rectilinear folded ribs 7 are bent at an angle of 45 degrees by the rolls 161 of the sixth roll forming means as shown in FIG. 8A. Then, the rolls 162 bend the side ends perpendicularly to form the L-shaped bends 6 shown in FIG. 8B. In the process, in order to minimize the roundness of the L-shaped bends 6, the rolls 162 bend the side ends perpendicularly while at the same time upsetting and pressing the L-shaped bends 6 from each extreme end portion of the side ends thereof.

Next, in the seventh roll forming step, the rolls 171 of the seventh roll forming means 170 bend the intermediate portion between each L-shaped bend 6 and the rectilinear folded rib 7 to the angle of 30 degrees. Then, the rolls 172 to 176, as shown in FIGS. 8C, 8D and 8E, bend the intermediate portion between each L-shaped bend 6 and the rectilinear folded rib 7 to the angles of 60, 105 (not shown), 120 (not shown), 150 and 180 degrees in that order. In this way, the first flat plate portions 3 and the second flat plate portions 4 are made parallel to each other, while at the same time bringing the L-shaped bends 6 into contact with the sides of the rectilinear folded rib 7. The roll forming process for the flat tube is, finished and thus the flat tube formed is fed into the cutting step by the conveyor roll means 180.

While the invention has been described with reference to specific embodiments chosen for purposes of illustration, it should be apparent that numerous modifications could be made thereto by those skilled in the art without departing from the basic concept and scope of the invention.

The invention claimed is:

1. A roll forming method for sequentially bending a single long band plate material into a flat tube including flat plate portion pairs opposed in relation to each other, a pair of curved plate portions connecting the ends of the flat plate portion pairs to each other and a folded rib rising upright from one of the opposed flat plate portion pairs and returning to the particular flat plate portion, the flat tube having a substantially θ-shaped section with a substantially elliptic space defined by the flat plate portion pairs, the pair of the curved plate portions and the folded rib, the method comprising:

a roll forming step (A) to form a substantially triangular protrusion having a roundish top on a flat plate portion of the band plate material, the substantially triangular protrusion further having two opposed base end portions and a forward end;

a roll forming step (B) to closely attach the two opposed base end portions while leaving a hollow portion at the forward end of the substantially triangular protrusion having a roundish top thereby to form a protrusion having the closely-attached base end portions and the forward-end hollow portion;

a roll forming step (C) to form the protrusion of step (B) into a folded rib with the entire two sides thereof closely attached to each other;

a roll forming step (D) to upset the folded rib from above and thus reduce a depression formed in the flat plate portion of the band plate material by bends between the flat plate portion and the folded rib;

a roll forming step (E) to form an L-shaped bend at each transverse end of the band plate material; and a roll forming step (F) to bend an intermediate portion between each L-shaped bend and the folded rib into a semicircle and opposing the flat plate portion pairs to each other while at the same time placing the L-shaped bends into contact with sides of the folded rib.

2. The method of roll forming a flat tube according to claim 1, wherein the roll forming step (A) is executed by a roll forming means having a pair of rolls, and in the roll forming step (A), a substantially triangular protrusion having a roundish top is formed from an isosceles trapezoidal protrusion precedently formed in the flat plate portion of the band plate material while the inner surface of the upper side of the isosceles trapezoidal protrusion is in contact with the flange-like portion projected diametrically from one of the rolls and having a roundness of a predetermined radius of curvature (R) at the forward end thereof.

3. A roll forming apparatus for sequentially bending and forming a single long band plate material into a flat tube including flat plate portion pairs in opposed relation to each other, a pair of curved plate portions connecting the ends of the flat plate portion pairs to each other and a folded rib rising upright from one of the opposed flat plate portion pairs and returning to the particular flat plate portion, the flat tube having a substantially θ-shaped section with a substantially elliptic space defined by the flat plate portion pairs, the pair of the curved plate portions and the folded rib, the apparatus comprising:

a roll forming means to form a substantially triangular protrusion having a roundish top on a flat plate portion of the band plate material, the substantially triangular protrusion further having two opposed base end portions and a forward end;

a roll forming means to closely attach the two opposed base end portions while leaving a hollow portion at the forward end of the substantially triangular protrusion having a roundish top thereby to form a protrusion having the closely-attached base end portions and the forward-end hollow portion;

a roll forming means to form the protrusion into a folded rib with both sides thereof closely attached to each other;

a roll forming means to upset the folded rib from above and thus reduce a depression formed in the flat plate portion of the band plate material by bend between the flat plate portion of the folded rib;

a roll forming means to form an L-shaped bend at each transverse end of the band plate material; and a roll forming means to bend an intermediate portion between each L-shaped bend and the folded rib into a semicircle and opposing the flat plate portion pairs to each other while at the same time placing the L-shaped bends into contact with sides of the folded rib.

4. The roll forming apparatus for the flat tube according to claim 3, wherein the roll forming means for forming the substantially triangular protrusion includes a pair of rolls, and wherein one roll of the roll pair includes a flange-like portion having a roundness of a predetermined radius of curvature at the diametrically projected forward end thereof, and when the substantially triangular protrusion having a roundish top is roll formed, the flange-like portion comes into contact with the inside of the top of the substantially triangular protrusion.

5. The roll forming apparatus for the flat tube according to claim 4, wherein the predetermined radius of curvature is substantially equal to the thickness of the band plate material.

6. The roll forming apparatus for the flat tube according to claim 3, wherein the roll forming means for forming the protrusion having the hollow portion has a pair of rolls, each of which has a large-diameter portion for pressing the closely-attached base end portions of the protrusion having the closely-attached base end portions and the forward-end hollow portion, and a small-diameter portion for forming the forward end having the hollow portion of the protrusion.

* * * * *